US008789336B2

(12) United States Patent
Lindberg

(10) Patent No.: US 8,789,336 B2
(45) Date of Patent: Jul. 29, 2014

(54) EDGE STRIP FOR MOUNTING OF A WALL BOARD

(75) Inventor: Peter Lindberg, Orebro (SE)

(73) Assignee: Oneday Wall AB, Orebro (SE)

( * ) Notice: Subject to any disclaimer, the term of this patent is extended or adjusted under 35 U.S.C. 154(b) by 0 days.

(21) Appl. No.: 13/981,569

(22) PCT Filed: Feb. 14, 2012

(86) PCT No.: PCT/SE2012/050147

§ 371 (c)(1),
(2), (4) Date: Oct. 11, 2013

(87) PCT Pub. No.: WO2012/112110

PCT Pub. Date: Aug. 23, 2012

(65) Prior Publication Data

US 2014/0026516 A1 Jan. 30, 2014

(30) Foreign Application Priority Data

Feb. 14, 2011 (SE) ..... 1150116-0

(51) Int. Cl.

| | |
|---|---|
| ***E04F 19/02*** | (2006.01) |
| ***E04F 19/06*** | (2006.01) |
| ***E04B 2/00*** | (2006.01) |

(52) U.S. Cl.

USPC ..... 52/718.04; 52/718.1; 52/718.01; 52/288.1

(58) Field of Classification Search

USPC ..... 52/716.1, 716.8, 718.01, 718.04, 52/717.05, 717.06, 581, 590.2, 287.1, 52/288.1, 311.2, 582.1–585.1, 586

See application file for complete search history.

(56) References Cited

U.S. PATENT DOCUMENTS

| | | | | | |
|---|---|---|---|---|---|
| 1,977,073 | A | * | 10/1934 | MacNab et al. | 52/464 |
| 2,007,244 | A | * | 7/1935 | Gathercoal | 52/288.1 |
| 2,511,074 | A | * | 6/1950 | Miller | 52/522 |
| 3,407,555 | A | * | 10/1968 | Pugh | 52/288.1 |
| 3,550,340 | A | | 12/1970 | Klein | |

(Continued)

FOREIGN PATENT DOCUMENTS

| | | |
|---|---|---|
| DE | 9005244 | 7/1990 |
| DE | 20017114 | 12/2000 |
| WO | WO2006/070280 | 7/2006 |
| WO | WO2010/044728 | 4/2010 |

OTHER PUBLICATIONS

International Search Report for PCT/SE2012/050147 dated Sep. 5, 2012.

(Continued)

*Primary Examiner* — Jeanette E. Chapman

(74) *Attorney, Agent, or Firm* — W. Kevin Ransom; Moore & Van Allen PLLC

(57) ABSTRACT

A proposed edge strip is attached on a wall structure for mounting of a wall board against the wall structure, The edge strip is composed of an elongated element suitable for length adaption through cutting in a length dimension to an extension of the wall structure in a specific dimension, for example the height of the wall. The edge strip comprises a connection part arranged in a first side extending in the length dimension. The connection part has click-in means configured to receive a fastening means integrated into the connection means of the wall board and interconnect the wall board and the edge strip, such that the wall board becomes attached to the wall structure.

7 Claims, 2 Drawing Sheets

(56) References Cited

U.S. PATENT DOCUMENTS

| | | | | |
|---|---|---|---|---|
| 3,992,839 | A | 11/1976 | La Borde | |
| 4,091,586 | A * | 5/1978 | Schwartz | 52/287.1 |
| 4,196,555 | A | 4/1980 | Henges, Jr. | |
| 5,894,701 | A * | 4/1999 | Delorme | 52/801.11 |
| 6,006,486 | A * | 12/1999 | Moriau et al. | 52/589.1 |
| 2004/0118062 | A1 * | 6/2004 | Meijer et al. | 52/287.1 |
| 2005/0102959 | A1 | 5/2005 | Hintze | |
| 2005/0247022 | A1 | 11/2005 | Poupart et al. | |
| 2007/0151180 | A1 * | 7/2007 | Pace et al. | 52/287.1 |
| 2008/0172962 | A1 * | 7/2008 | Harrison | 52/287.1 |
| 2009/0038247 | A1 * | 2/2009 | Taylor et al. | 52/287.1 |
| 2010/0122505 | A1 | 5/2010 | Jakiel | |

OTHER PUBLICATIONS

International Preliminary Report on Patentability for PCT/SE2012/050147 dated Aug. 29, 2013.

* cited by examiner

EDGE STRIP FOR MOUNTING OF A WALL BOARD

BACKGROUND TO THE INVENTION AND THE PRIOR ART

The present invention relates generally to solutions for mounting panelling onto a wall structure of a building. In particular, the invention pertains to an edge strip according to the preamble of claim 1.

Today, there are many solutions for mounting panelling in the form of wooden panels and similar onto the inner walls of a room. Moreover, established methods exist for mounting other types of panelling in a room, such as plasterboards, fibreboards or boards of laminated wood. A common denominator of the latter methods is that these require particular measures to accomplish nice looking joints between the different wall elements of the panelling. To combine an aesthetically pleasant appearance of the finished wall with an uncomplicated and cost-efficient manufacturing of the panelling elements, and at the same time allow a simple mounting, has therefore proven to be especially challenging.

WO 2006/070280 describes a prefabricated wall panel, which allows quick mounting of a decorative panelling. Here, each panel element is mounted by inserting a male side of the element in parallel with the wall into a female side of an earlier mounted wall element.

Moreover, U.S. Pat. No. 3,992,839 discloses a design solution, wherein each panel element in a wall panel is composed of an inner part and an outer part, which are connected with one another through a click-in procedure. Furthermore, particular corner and end parts are proposed, which are inserted vertically into the panel elements in order to achieve an appealing appearance of the finished mounting.

U.S. Pat. No. 4,196,555 shows a wall structure, where the wall parts are supporting and are connected with one another by a first part being angled into a second part via a hinge joint.

U.S. 2005/0247022 discloses a wall panel system, where panel boards of a stucco-like material are adhered to a wall by the panel boards being inserted horizontally one after the other from bottom to top along the wall. The document also shows edges for inner and outer corners respectively, which edges render it possible to attach the panel so that it adjoins right-angled protrusions and ledges.

PROBLEMS ASSOCIATED WITH THE PRIOR ART

The known solutions have their pros and cons respectively. In any case, there is no known solution, which enables a nice looking mounting of wall boards in corners, for example of the type described in WO 2010/044728, with essentially invisible joints and without any post processing being required for covering, or by other means concealing the joints between the wall boards.

SUMMARY OF THE INVENTION

The object of the present invention is to offer a solution which solves the above problems and thereby provides an efficient and aesthetically appealing mounting of wall boards on a wall structure, which wall boards are cost-efficient to produce.

According to the invention, the object is achieved by the initially described edge strip, wherein the connection part comprises click-in means configured to receive the connection means of the wall board and thereby interconnect the wall board and the edge strip, such that the wall board becomes attached to the wall structure.

This edge strip is advantageous, since it allows a simple mounting of the wall boards, and at the same time, the edge strip itself becomes virtually invisible on the finished wall.

According to one embodiment of the invention, the click-in means comprises a groove configured to receive the connection means of the wall board. This connection means, in turn, is presumed to include a projection to whose geometric properties the dimensions of said groove are adapted. Thereby, after mounting on the wall structure, the edge strip appears as an already mounted wall board. This, of course, vouches for a convenient and uniform mounting procedure.

According to another embodiment of the invention, the groove in the click-in means is delimited by a first tongue and a second tongue. The first tongue is configured to be fitted against the wall structure and be fixated thereto via through fastening means, and the second tongue is configured to squeeze in the projection of the wall board's fastening means against the first tongue. Thereby, the wall board is fastened securely in the edge strip, and thus also becomes fixated towards the wall structure.

According to another embodiment of the invention, the groove in the click-in means has a curved cross section profile configured to receive the projection of the fastening means while the wall board is being angled in against the wall structure. This is advantageous since it facilitates the mounting of the wall board in the edge strip substantially.

According to yet another embodiment of the invention, the edge strip comprises an adaption part, which is arranged in a second side opposite to the first side, and extends in the length dimension. The adaption part is configured to contact against a flat building element of the wall structure. Such a design of the edge strip is desirable because it simplifies a discrete and aesthetically appealing mounting of the edge strip in connection with corners.

According to still another embodiment of the invention, the edge strip comprises a third side and a fourth side, which both extend in the length dimension and are mutually opposite to one another. Moreover, the adaption part consists of a flat side surface, which shows a first angle of 45 degrees towards the third side and a second angle of 135 degrees towards the fourth side. Thereby it becomes simple to mount the edge strip with tight contacting against an existing wall structure, for example an inner corner of a room.

In particular, however, such an edge strip is adapted, to cooperate with another edge strip at a right-angled outer corner. A first edge strip is here attached on a primary side of the corner, such that exclusively (however all of) its adaption part protrudes outside the corner. In a corresponding manner, a second edge strip is attached on a secondary side of the corner, such that the edge strips together form an unbroken corner element. Starting from this element, wall boards may then be attached to the wall structure along the primary side and the secondary side respectively. Such an outer corner thus constitutes a suitable starting point for mounting of wall boards in two directions in a room.

According to another embodiment of the invention, the adaption part's flat surface in the first and second edge strip respectively is configured to receive a joining plate for fixating the first edge strip relative to the second edge strip. Thereby, it can be ensured the corner element is formed without gaps between the two edge strips.

According to a further embodiment of the invention, the edge strip has a thickness in a dimension perpendicular to the length dimension, which thickness is in accordance with a thickness of the wall board. Thereby, after being fastened against the wall structure by means of the edge strip, the wall board forms a flat surface together with the edge strip, which, of course, is desirable in order to reduce the visibility of the joint between the edge strip and the wall board.

BRIEF DESCRIPTION OF THE DRAWINGS

The invention will now be more closely described by means of embodiments, which are described as examples, and with reference to the attached drawings.

DESCRIPTION OF PREFERRED EMBODIMENTS OF THE INVENTION

Figure 1A:
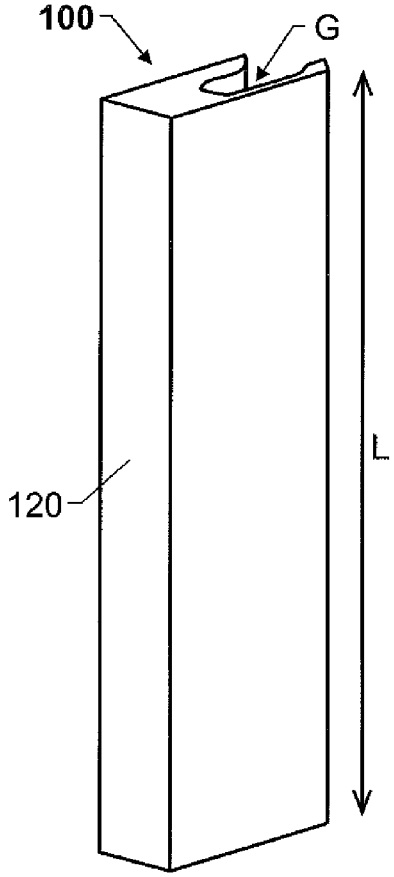
FIG. 1*a* shows a schematic image of a proposed edge strip.

Initially, we refer to FIG. 1, which schematically illustrates a proposed edge strip 100 configured to be fastened on a wall structure and thus facilitate an aesthetically appealing mounting of a wall board against the wall structure. The edge strip 100 may be manufactured of aluminium, plastic, wood, MDF (Medium Density Fibreboard), or any other relatively hard material. The wall board is presumed to be provided with fastening means, for example of male type, and therefore the edge strip 100 has a connection part, for example of female type and comprising a groove G, configured to be connected to the connection means of the wall board. The edge strip 100 is composed of an elongated element, which is suitable for length adaption through cutting in a length dimension L to an extension of the wall structure in a specific dimension. If the wall boards are mounted with vertical joints along the wails of a room, thus the edge strip 100 is saw cut so that its length L becomes essentially equal to the ceiling height of the room.

Figure 1B:
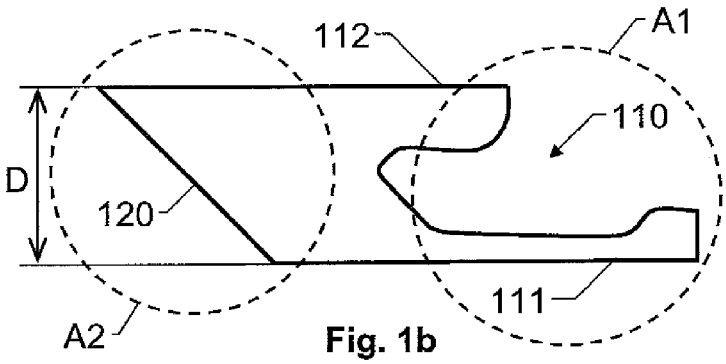
FIG. 1*b* shows a cross section of the edge strip according to one embodiment of the invention.
Figure 2:
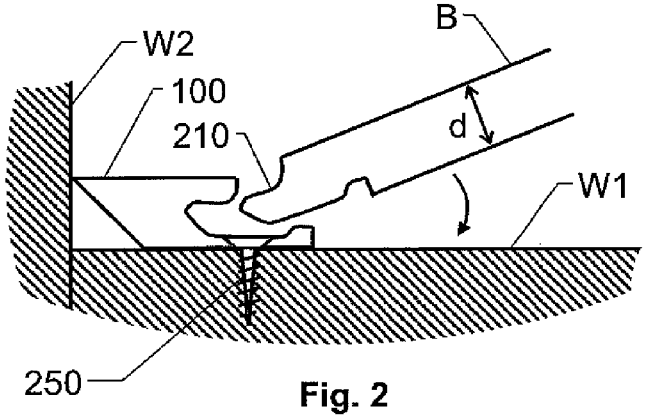
FIG. 2 illustrates how a wall board may be mounted against a wall structure by means of the proposed edge strip.
Figure 3:
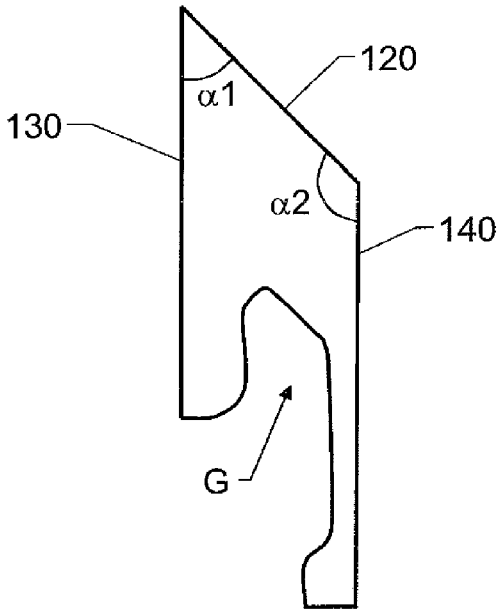
FIG. 3 illustrates, with reference to a cross section of the edge strip, certain properties of the edge strip according to embodiments of the invention.

FIG. 1*b* shows a cross section of the edge strip 100 according to one embodiment of the invention. FIG. 2 illustrates how a wall board B may be mounted against a wall structure W1 by means of the proposed edge strip 100. In FIG. 1*b* a connection part A1 is visible, which extends in the length dimension L of the edge strip 100. The connection part A1 is configured to be connected to a connection means in the wall board. The connection part A1 and its cooperation with the connection means will be described in further detail below with reference to FIGS. 3-7.

Given that the wall board B is provided with a fastening means 210 of male type, and the edge strip therefore in its first side 110 has a click-in means with a groove G (i.e. of female type), this area is preferably delimited by a first tongue 111 and a second tongue 112. The first tongue 111 is configured to be fitted against the wall structure W1 and thus be fixated thereto via one or more through fastening means 250. The second tongue 112 is configured to squeeze in a protrusion of the wall board's B fastening means 210 against the first tongue 111. The groove G in the connection means A1 is thereby adapted to receive the fastening means 210 of the wall board B and thus interconnect the wall board B and the edge strip 100 so that the wall board B, in turn, is attached in the edge strip 100 and is likewise fixated at the wall structure W1.

According to one preferred embodiment of the invention, the groove G in the click-in means has a curved cross section profile configured to receive the protrusion of the connection means 210 while the wall board B is being angled in against the wall structure W1 as illustrated in FIG. 2. The connection means 210 is here presumed to be integrated into the wall board B (e.g. as described in WO 2010/044728) and preferably extends along an entire side of the wall board B.

As can be seen in FIG. 1*b*, the edge strip 100 has a thickness D in a dimension perpendicular to the length dimension L. According to a preferred embodiment of the invention, the thickness D is in accordance with a thickness d of the wall board B. This is advantageous, since thereby the wall board B after being fastened against the wall structure W1 by means of the edge strip 100, forms a flat surface together with the edge strip 100. Provided that the click-in means of the edge strip 100 is adapted to the wall board's B fastening means 210 according to what is described below with reference to FIG. 3, the joint surface between the edge strip 100 and the wall board B can also be made very small, and thereby be nearly invisible.

FIG. 3 again shows a cross section of the edge strip 100 according to one embodiment of the invention. Here, it is shown that the click-in means' groove G has rounded delimitation surfaces, which are configured to receive the fastening means 210 of the wall board B in a manner being advantageous from a mounting point-of-view, namely by the above-described angling in of the wall board B against the wall structure W1. Furthermore, the dimensions of the groove G are adapted to the geometric properties of the fastening means' 210 protrusion, such that after mounting, a minimal play occurs between the protrusion and the groove G.

According to one embodiment of the invention, the edge strip 100 comprises a third side 130 and a fourth side 140, which both extend along the length dimension L and are mutually opposite to one another. The third side 130 is arranged to be visible after mounting (and may thus be painted or provided with wall paper), while the fourth side 140 is arranged to be fitted against the wall structure W1. The adaption part A2 is composed of a flat side surface 120, which shows a first angle $\alpha 1=45$ degrees towards the third side 130 and a second angle $\alpha 2=135$ degrees towards the fourth side 140. Hence, the edge strip's 100 front side (i.e. the third side 130) forms a relatively sharp edge against the surface 120 of the adaption part A2. This is desirable when mounting the edge strip 100 with contacting against a flat building element W2 of the wall structure, as shown in FIG. 2, because said edge at mounting may deform any smaller unevenness in the corner and accomplish contact without gaps towards the building element W2. Said angle relationship between the sides 120, 130 and 140 is also beneficial for other reasons, which will be elaborated upon below with reference to FIG. 4.

Figure 4:
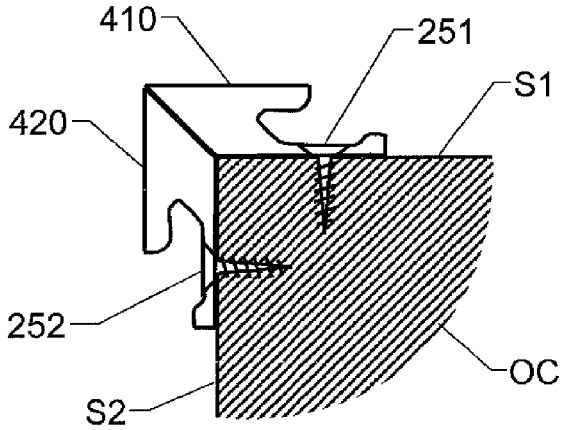
FIGS. 4 and 6 illustrate how a pair of edge strips, according to one embodiment of the invention, may be used for mounting wall boards at a right-angled outer corner.

FIG. 4 shows how a pair of edge strips 410 and 420 according to one embodiment of the invention can be used to mount wall boards at a right-angled outer corner OC in a wall structure. A first edge strip 410 is here attached by means of attachment means 251 on a primary side S1 of the corner OC, such that edge strip's 410 entire (however nothing more) points out from the corner OC itself. Analogously, a second edge strip 420 is attached by means of fastening means 252 on a secondary side S2 of the corner OC.

Since the corner OC is right-angled (i.e. encompasses an angle of 90 degrees), and the side surfaces 120 of the adaption parts A2 are located 135 degrees beyond the sides S1 and S2 respectively, the side surfaces 120 are co-located and cooperate, such that together the edge strips 410 and 420 form a corner element, which encloses the outer corner OC without a gap. To ensure that no gaps occur in the corner element, the edge strips 410 and 420 may be joined together by through a joining plate 610 (see FIG. 6) before being attached to the outer corner OC. In any case, starting from the corner element, wall boards may then be attached to the wall structure along the primary side S1 as well as the secondary side S2 in the manner described below with reference to FIGS. 5 and 6.

Figure 5:
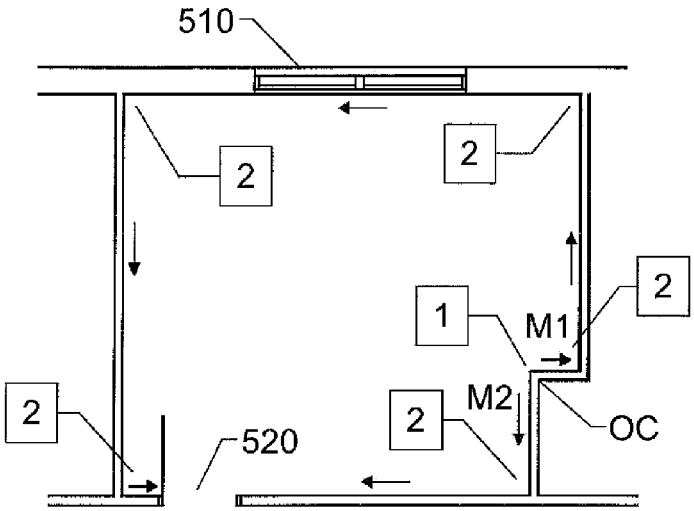
FIG. 5 illustrates a proposed mounting procedure for wall boards in a room by using the edge strip according to the invention.
Figure 6:
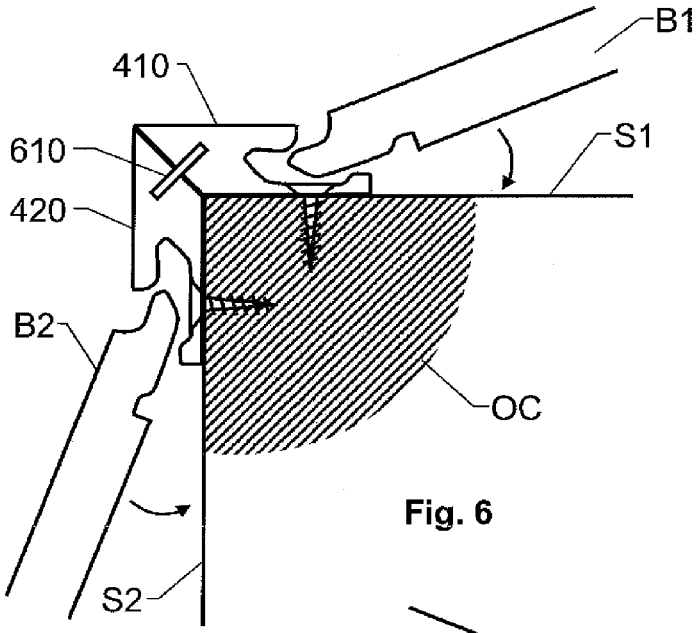

FIG. 5 illustrates a proposed general mounting procedure for wall boards in a room by using the edge strip according to the invention. We assume that the room has a right-angled outer corner OC. The mounting is initiated by attaching a pair of edge strips 410 and 420 respectively at the corner OC as described above with reference to FIG. 4. Thereafter, the mounting continues with attachment of a first wall board B1 along the primary side S1 in a first mounting direction M1 and attachment of a second wall board B2 along the secondary side S2 in a second mounting direction M2 as is apparent from the arrows in FIG. 6. As mentioned above, it is advantageous if the adaption part's A2 flat side surface 120 in the first edge strip 410 and the second edge strip 420 respectively are configured to receive a joining plate 610, such that the first edge strip 410 is fixated relative to the second edge strip 420, preferably before the edge strips 410 and 420 are attached to the corner OC. Namely, thereby, it is possible to ensure that no gaps occur between the edge strips 410 and 420. Consequently, the side surface 120 of the edge strips 410 and 420 preferably comprises a notch configured to receive the joining plate 610 as shown in FIG. 6.

In FIG. 5 the fact that the mounting of the wall boards is initiated at the outer corner OC is illustrated by means of a framed reference numeral 1. The two mounting directions M1 and M2 then meet at an appropriate point in the room, such as at the door opening 520.

Figure 7:
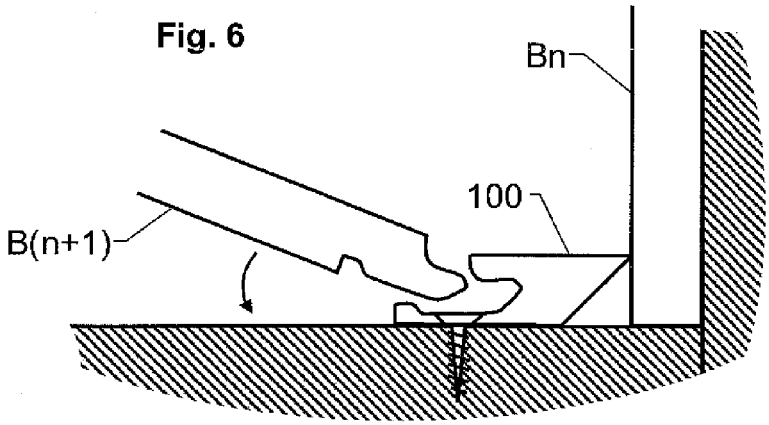
FIG. 7 shows how an edge strip according to one embodiment of the invention may be used for mounting wall boards at a right-angled inner corner.

When, during mounting a particular wall board Bn, a right-angled inner corner of the room is reached, which in FIG. 5 is illustrated by means of a framed reference numeral 2, the wall board Bn is adapted (i.e. cut) vertically, such that the wall board Bn reaches up to the corner in question as shown in FIG. 7. Then, an edge strip 100 is attached against the wall board Bn as described above with reference to FIG. 2, where after the mounting continues with a subsequent wall board B(n+1), and so on. If there is a window 510 or a door opening 520, the wall boards are adapted to the measures of the window 510 and the door opening 520 respectively as is customary. The wall boards are thereafter attached along the window and door frame respectively, and are covered with linings as is customary.

If the room has more than one outer corner OC, the mounting starts from each of these corners OC and meet at appropriate points in the room, such as at door openings or windows.

If the room lacks outer corners OC, the mounting starts at arbitrary inner corner as shown in FIG. 2. Here; however, also a second edge strip is attached against the wall structure W2. The mounting then continues in both directions and meet at an appropriate point in the room, such as at a door opening.

According to the invention, the front side of the edge strip 100 (the third side 130) as well as of the wall board B is provided with the final surface covering, such as a desired wall paper and/or other surface material, upon mounting.

The invention is not restricted to the described embodiments in the figures, but may be varied freely within the scope of the following claims.

The invention claimed is:

1. An edge strip configured to be attached to a wall structure for the mounting of a wall board against the a wall structure, the edge strip being composed of an elongated element suitable for length adaption through cutting in a length dimension to an extension of the wall structure in a specific dimension, the edge strip comprising:

a connection part arranged in a first side extending in the length dimension and is configured to be connected to a connection means integrated into the wall board, which connection means extends along a first side of the wall board, such that the wall board is attached to the wall structure, the connection part comprising click-in means configured to receive the connection means of the wall board and interconnect the wall board and the edge strip, such that the wall board becomes attached to the wall structure, and an adaption part arranged in a second side opposite to the first side, which adaption part extends in the length dimension and is configured to contact against a flat building element of the wall structure, a third side and a fourth side both extending in the length dimension and being mutually opposite to one another, and wherein the adaption part consists of a flat side surface that intersects both the third and fourth sides and has a first angle of 45 degrees relative to the third side and a second angle of 135 degrees relative to the fourth side.

2. The edge strip according to claim 1, wherein said connection means of the wall board comprises a projection and said click-in means comprises a groove configured to receive the projection of said connection means.

3. The edge strip according to claim 2, wherein the groove in said click-in means comprises:

a first tongue configured to be fitted against the wall structure and connected thereto using fastening means, and a second tongue spaced apart from the first tongue and configured to mate with the projection of said connection means.

4. The edge strip according to claim 2, wherein the groove in said click-in means has a curved cross section profile configured to receive the projection of the fastening means while the wall board is being angled in against the wall structure.

5. The edge strip according to claim 1, wherein the edge strip is a first edge strip and its adaption part is configured to be attached on a primary side of a right-angled outer corner in the wall structure and there cooperate with the adaption part of a second edge strip being attached on a secondary side of the right-angled outer corner such that the edge strips by contacting between the respective adaption parts together form a corner element starting from which wall boards may be attached to the wall structure along the primary side and the secondary side respectively.

6. The edge strip according to claim 5, wherein the adaption part's flat surface in the first and second edge strip respectively is configured to receive a joining plate for fixating the first edge strip relative to the second edge strip.

7. The edge strip according to claim 1, wherein the edge strip has a thickness in a dimension perpendicular to the length dimension, which thickness is in accordance with a thickness of the wall board, such that the wall board after being fastened against the wall structure by means of the edge strip forms a flat surface together with the edge strip.

* * * * *